US005816948A

United States Patent [19]

Davies, Jr. et al.

[11] Patent Number: 5,816,948

[45] Date of Patent: Oct. 6, 1998

[54] BASKETBALL RIM SECURITY LOCK PROTECTOR

[76] Inventors: Raymond C. Davies, Jr.; Deborah M. Davies, both of 5552 Osage Ave., Philadelphia, Pa. 19143; Jerome L. Munford, 3636 Belmont Rd., Birmingham, Ala. 35210; William L. Banks, 5550 Osage Ave., Philadelphia, Pa. 19143

[21] Appl. No.: 523,156

[22] Filed: Sep. 5, 1995

[51] Int. Cl.[6] ..... A63B 63/08

[52] U.S. Cl. ..... 473/485

[58] Field of Search ..... 273/1.5 R; 70/14, 70/57, 158; 473/485

[56] References Cited

U.S. PATENT DOCUMENTS

| | | | |
|---|---|---|---|
| 2,710,189 | 6/1955 | Carrolll | 273/1.5 A |
| 3,910,574 | 10/1975 | Voltz et al. | 273/1.5 A |
| 4,903,964 | 2/1990 | Anderson | 273/1.5 R |
| 5,433,095 | 7/1995 | Mitchell et al. | 273/1.5 X |
| 5,439,210 | 8/1995 | Davis | 273/1.5 R |

*Primary Examiner*—Paul E. Shapiro

*Attorney, Agent, or Firm*—Volpe and Koenig, P.C.

[57] ABSTRACT

A basketball rim security lock protector is a single, one piece device which prevents unauthorized use, vandalism and destruction of unoccupied goal rims or hoops. The basketball rim security lock protector contains a sheet of hardened, sturdy material whereby the opening of a basketball rim is temporarily sealed, an appendage which has a claw for attachment to a standard basketball rim, and an opening on the sheet which allows for adjustment and attachment to a standard basketball rim.

10 Claims, 9 Drawing Sheets

BASKETBALL RIM SECURITY LOCK PROTECTOR

BACKGROUND OF THE INVENTION

A convenient, easy to use, removable, locking mechanism was required to control the flow of unauthorized basketball activities as well as the wanton destruction of basketball rims and goals.

1. Field of Invention

This patent relates to the invention of a removable basketball rim or hoop security locking cover to prevent the unauthorized use, destruction and vandalism of unoccupied basketball rims or hoops.

2. Description of Prior Art

Efforts to protect vacant, standing basketball rims or hoops from unauthorized usage, destruction and vandalism have been utilized in various prior art. U.S. Pat. No. 3,467,377 and U.S. Pat. No. 3,614,099 attempt to minimize the use of vacant rims or hoops by folding down or retracting the entire goal structure which includes both the rim and backboard, onto the ceiling where the structure is attached. Both types are insufficient because neither provide the individual private homeowner or public user the affordability or convenience that our invention allows. Also these pre-existing designs are inadequate on account of the high installation and maintenance costs necessary to effectively employ them. These inventions are also inadequate to address the issue presented by our invention due to the large amount of space and size required to operate these mechanisms.

Other U.S. Patents, specifically U.S. Pat. No. 3,881,724 and U.S. Pat. No. 3,880,392, similarly discourage unauthorized use, but the function remains limited because, these "retractable ceiling goals" can not be used by the average homeowner. They can only operate inside a facility equipped to permit an entire basketball backboard and rim assembly, which permits them to be lowered from the ceiling while in use, then raised and mounted when not in use. Costs of installation and maintenance of such a large mechanism are prohibitive for an individual homeowner. Furthermore, since the homeowner does not have either the space, equipment or ceiling to mount and retract an entire basketball goal to deter intruders or unauthorized persons, these systems have no value to them. U.S. Pat. No. 3,722,886 provides for a movable stand for a basketball goal, but it does not address the problem of protecting the rim from intrusion on a stationary goal. Other references address the problem of unauthorized use through collapsible goals, such as discussed in U.S. Pat. No. 3,820,784 and U.S. Pat. No. 4,397,464, but these systems do not have the simplicity or convenience of the instant invention.

Accordingly, it may be appreciated there continues to be a need for a new, convenient, easy to use, removable locking mechanism created exclusively to prevent open or vacant basketball goals found in private homes, public recreational centers, gyms and clubs from being subjected to unauthorized use, destruction and vandalism. The instant invention addresses this problem and substantially fulfills this need.

SUMMARY OF THE INVENTION

In view of the foregoing disadvantages inherent in the known types of the goal apparatus now present in the prior art, the present invention provides a removable, convenient, easy to use, basketball rim or hoop security lock wherein the same is designed to permit its owner the ability to prevent unauthorized persons from using, vandalizing or destroying an open or vacant standing goal. As such, the general purpose of the present invention, which will be described subsequently in greater detail provides a new and improved method of controlling the usage, destruction and vandalism of open or vacant basketball goals. The invention provides a solution to the problem in an area where several previous methods of locking basketball rims, while the rims were not in use, have failed.

The present invention prevents the unwanted usage, destruction, and vandalism of public and privately owned basketball goals.

Additionally, it provides a new basketball rim security cover which may be easily and efficiently manufactured and marketed.

The present invention provides a simple, but effective deterrent to persons from attempting to illegally remove an unprotected basketball rim for illegal reuse or resale purposes.

With the present invention, basketball goal owners have the opportunity to control overall basketball activities, thereby preventing possible instances of trespass, public disturbance and vandalization.

The present invention provides a simple, convenient, easy to use, low cost removable locking mechanism for a standard basketball rim or hoop.

Additionally, the present invention provides a simple, convenient easy to use, low cost removable locking mechanism, which if employed properly, serves to extend the ordinary life of a standard or even breakaway basketball rim.

The present invention provides an aesthetic value to its owners by eliminating unsightly, unusable, busted or torn down basketball rims located in both public and private areas.

The present invention provides a new basketball goal security cover which is susceptible to a low cost of manufacture with regard to both materials and labor, and which accordingly is then susceptible to low prices of sale to the consuming public, thereby making such security device economically available to the buying public.

The instant invention overcomes the deficiencies of the prior art by providing for a one piece, easy to use, removable locking device of solid construction, made of such materials as wood, fiberglass, plastic or stainless steel designed to fit smoothly and completely over the entire structure known as the basketball rim or hoop.

For a better understanding of the invention, its operating advantages and the specific objects attained by its uses, reference should be had to the accompanying drawings and descriptive matter in which there is illustrated preferred embodiments of the invention.

The operation of the invention will be better understood and additional advantages will become apparent when consideration is given to the following detailed description thereof made with reference to the annexed drawing herein.

DESCRIPTION OF THE PREFERRED EMBODIMENTS

Figure 1:
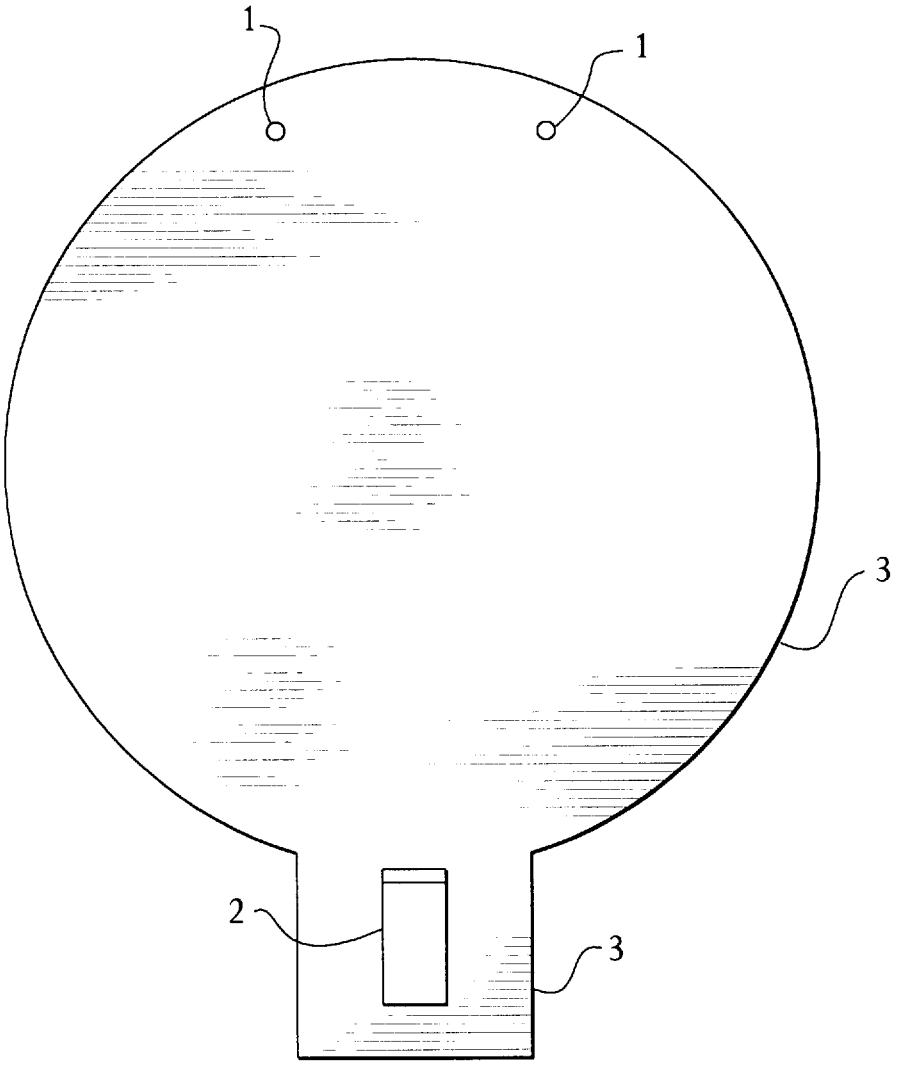
FIG. 1 is a bottom plan view of the invention showing locking holes, cover and rim claw.
Figure 2:
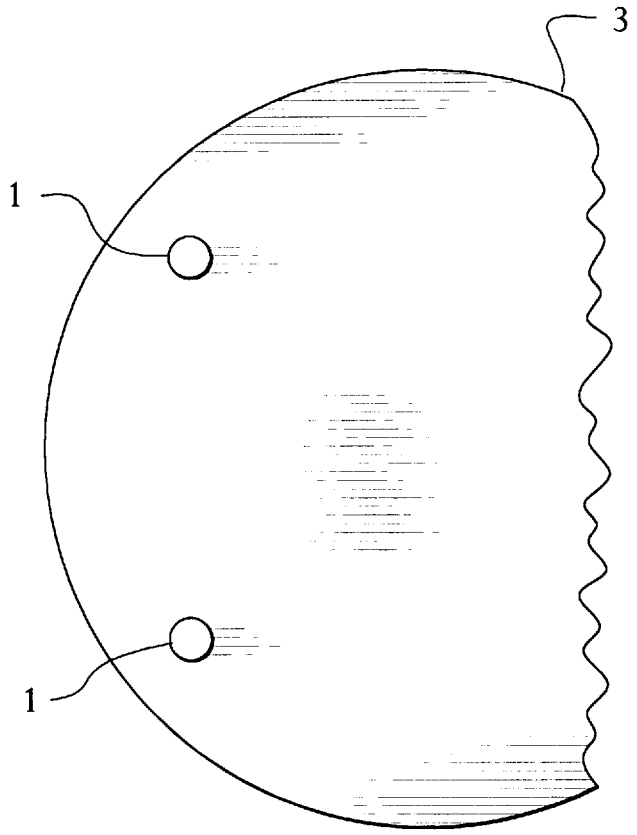
FIG. 2 is a bottom plan view of the invention showing the front section of the cover.
Figure 3:
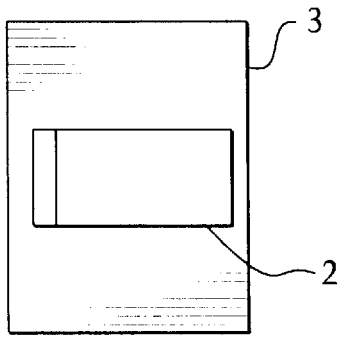
FIG. 3 is a partial bottom plan view of the invention showing the rear section of the cover containing the rim claw.
Figure 4:
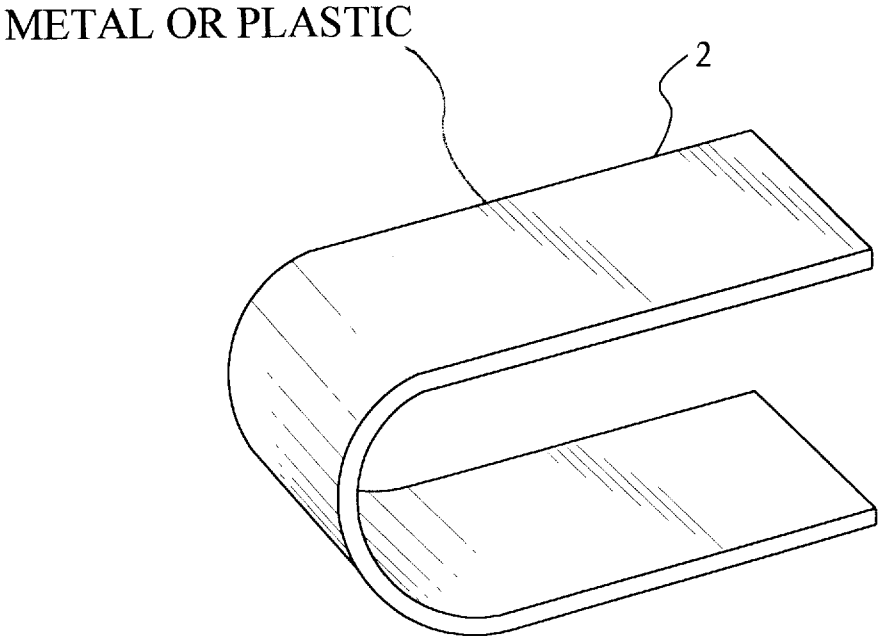
FIG. 4 is an enlarged view of the rim claw grappling device.
Figure 5:
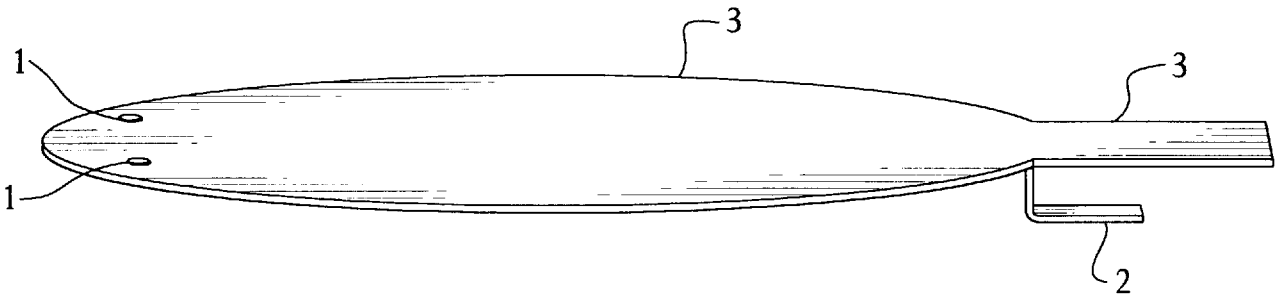
FIG. 5 is a side elevational view of the invention.
Figure 6:
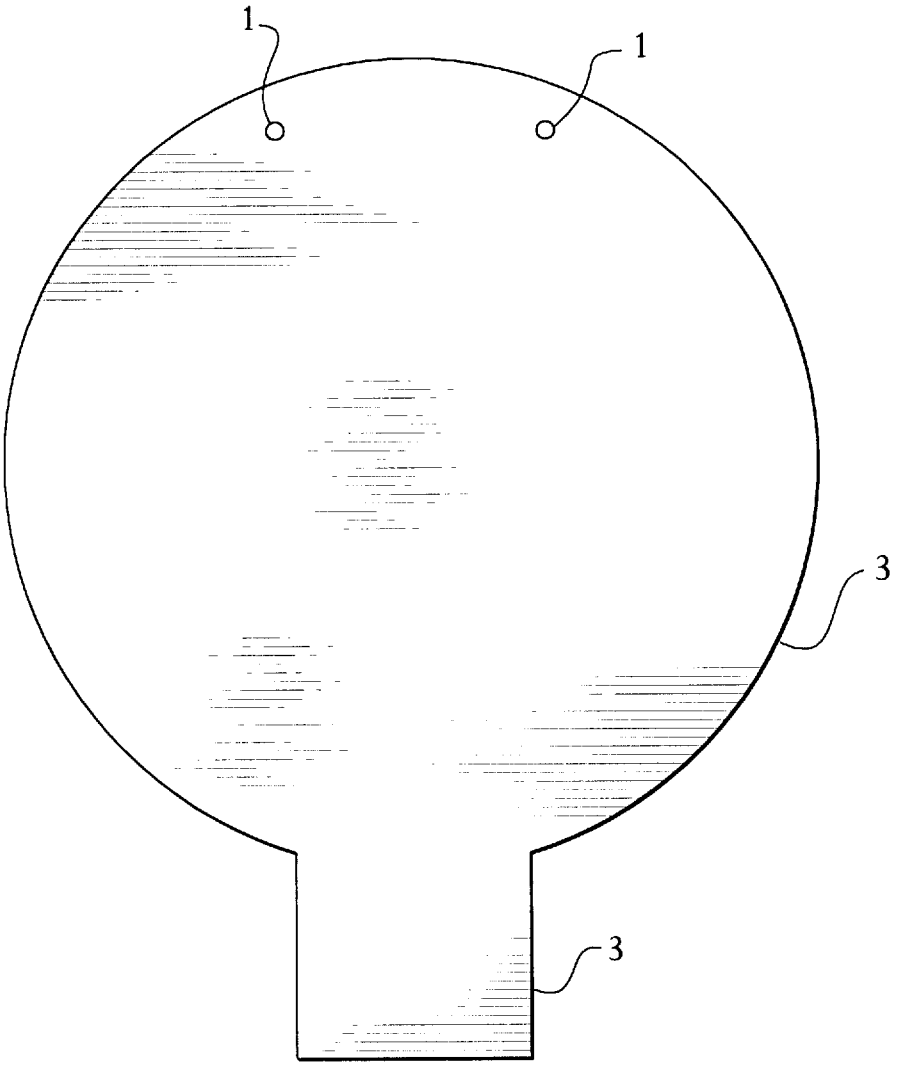
FIG. 6 is a top plan view of the invention.

As exemplified in the drawings, the rim security lock protector includes a rim claw (2), and a cover (3) which has at least one locking hole (1). The placement of the rim security lock protector is further shown engaged with a basketball goal assembly in the drawing FIGS. 9 and 10. The basketball goal (8) is comprised of a basketball rim (4), basketball rim net (5), basketball rim support (6), and basketball backboard (7).

The cover (3) with a grapple, strap or rim claw (2) fits onto the rear rim support or rear section of the rim, and has at least one hole (1) that allows placement of a locking device (9) that secures the protective device onto the goal rim.

The cover portion of the rim security lock protector may be any material such as wood, fiberglass, plastic, metal, such as stainless steel, or any other composition which allows the formation of a solid cover. Additionally, the top surface of the cover of the rim security lock protector may be covered with a smooth or low friction coating (20) to make it impossible for someone to hang onto the goal rim, preventing it from being torn down by force. The cover is designed to cover a goal sufficiently to prevent use of the goal, and to prevent gripping of the goal. In a preferred embodiment, for such goals as used in basketball games, the cover may be round to cover the basketball rim, with an additional portion of the cover which extends to the backboard and covers the rim support of the basketball goal. For instance, the rim security lock protector works on both standard and break-away basketball rims that are currently in use throughout public and private basketball courts.

The rim claw (2) may be referred to as a grapple or strap. It is centered on the rear section of the cover (3), as shown in FIG. 1, and slides over and under the goal rim support.

Figure 7:
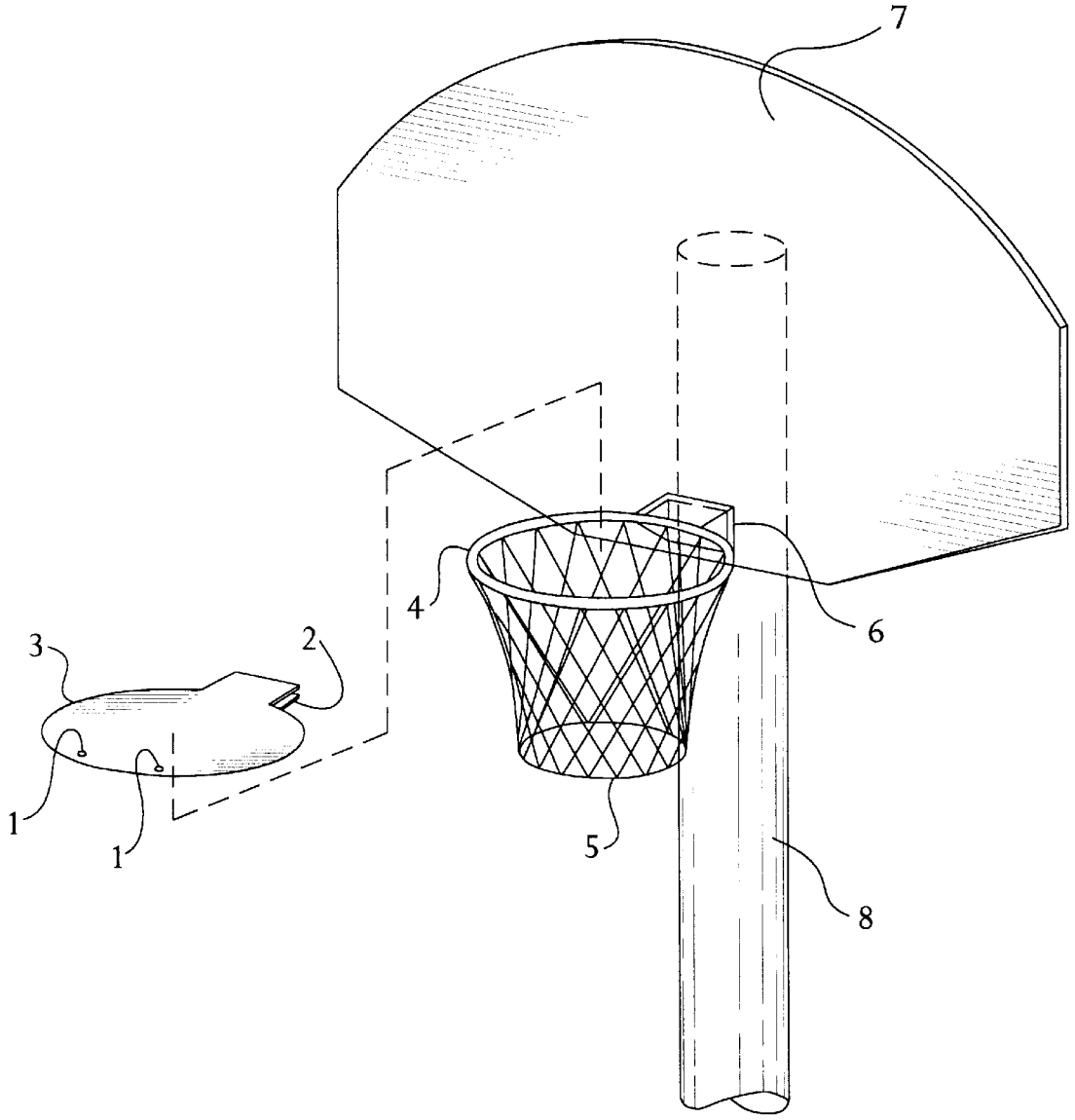
FIG. 7 is an orthographic view of the invention exploded away from a standard basketball goal with backboard and pole.
Figure 8:
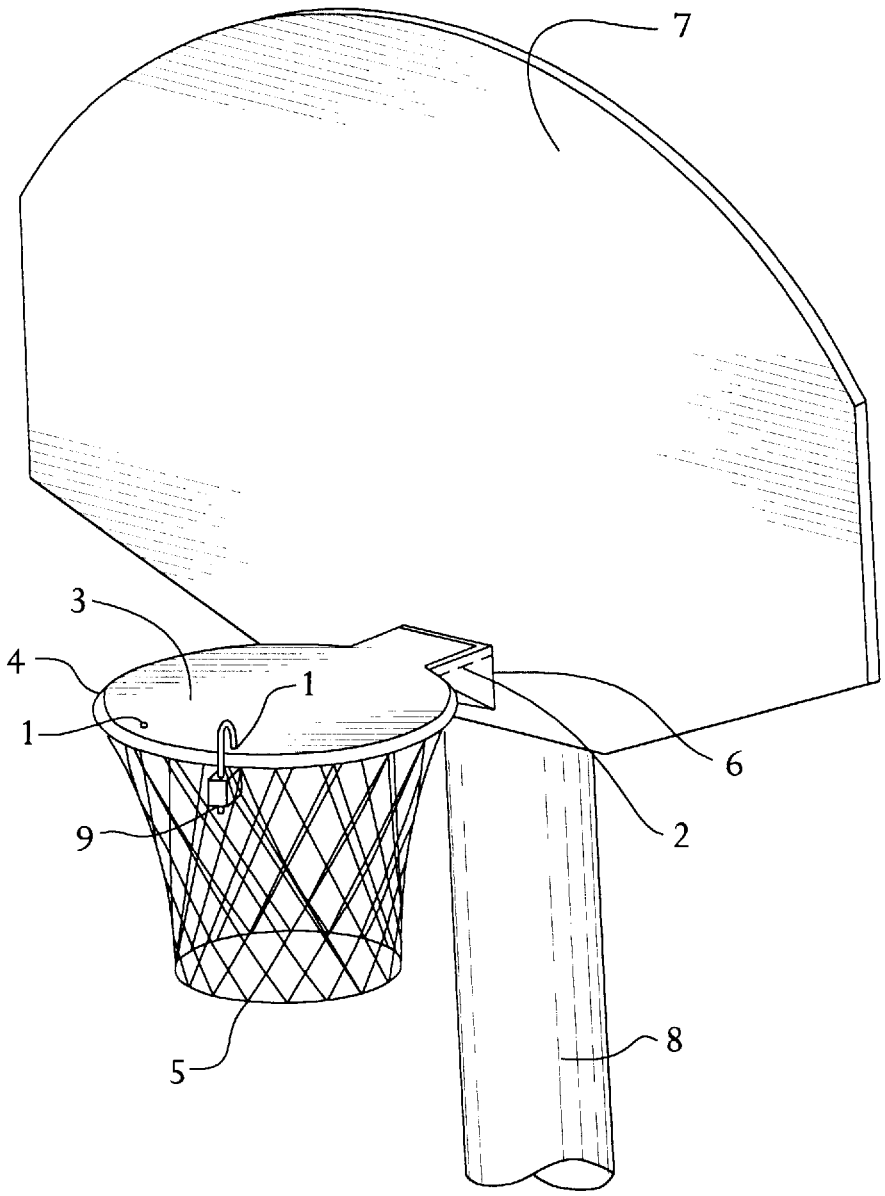
FIG. 8 is an orthographic view of the invention attached to a basketball goal with backboard, secured with a padlock.
Figure 9:
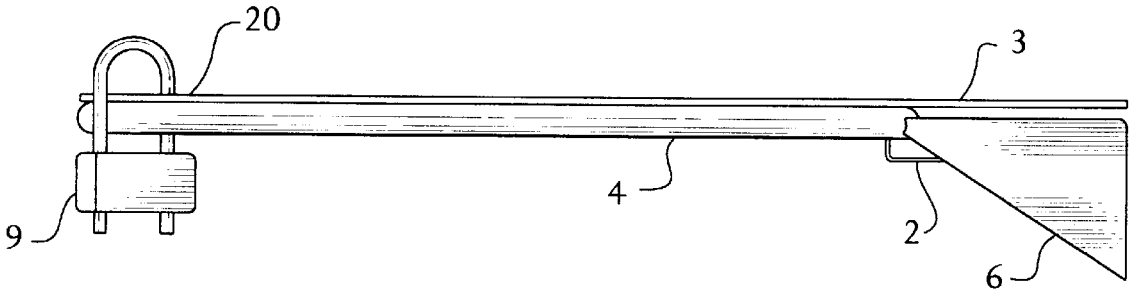
FIG. 9 is a side elevational view of the invention attached to a standard basketball goal, independent of backboard, secured with a padlock.
Figure 10:
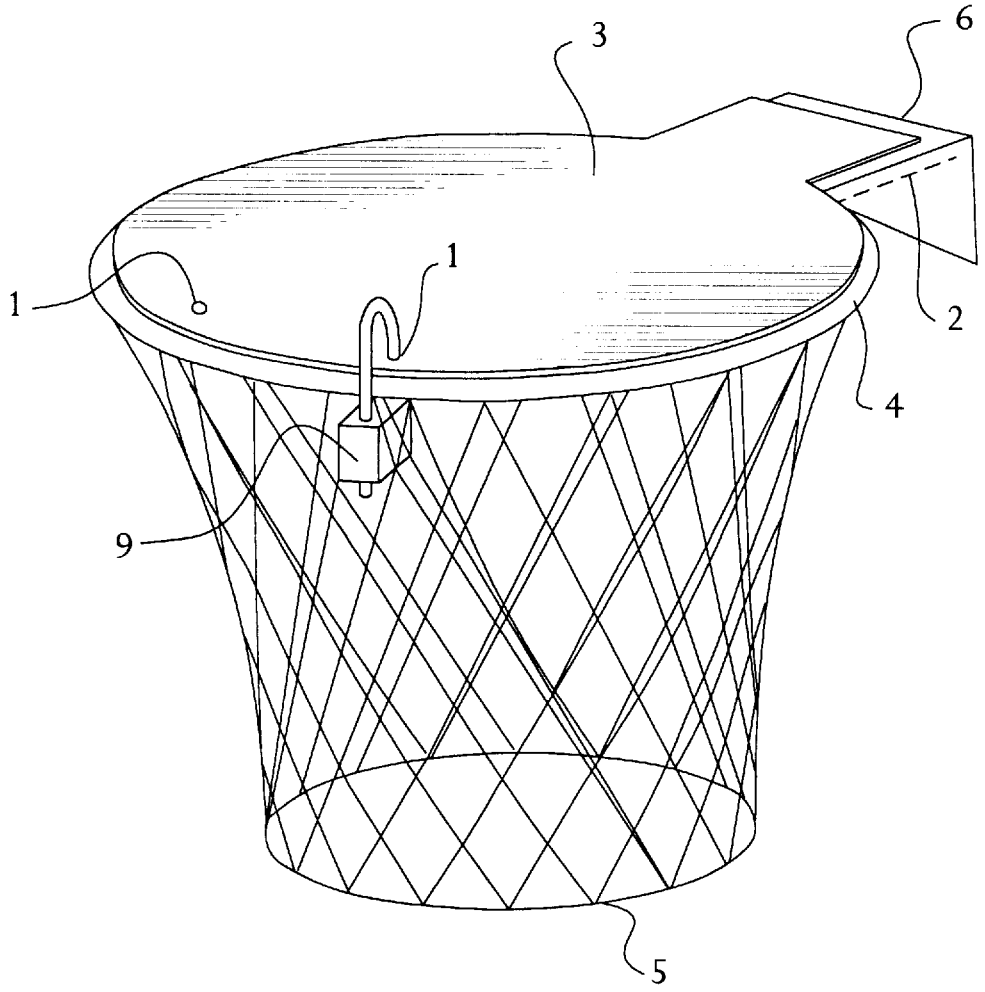
FIG. 10 is an orthographic view of the invention installed on a basketball goal.

The locking holes (1) of the present invention provide a means to lock the rim security lock protector to a goal. Each locking hole is configured and positioned to allow a locking mechanism to encircle or encompass a section of the cover and the goal. In a preferred embodiment, the locking holes (1) are proximate to the front portion of the cover (3), are adjusted closely to the front of a basketball rim (4) so as to allow the passage of a padlock through the locking holes and surrounding the outer edge of the cover (3) and the basketball rim (4) as shown in FIGS. 7, 8 and 9, locking the front and the back of the cover (3) firmly in place. This prevents any object or projectile from passing through the rim (4) as well as the hanging, pulling or destroying of the basket rim or goal.

The present invention is ideally suited to protect a basketball goal. A preferred embodiment of the present invention provides a solid 19 inch diameter flat cover connected by means to a specifically designed 7 and ½ inch molded U shaped grapple or "rim claw" with two ⅜ inch diameter holes located 6 inches apart from edge to edge of each hole 1 inch from the front edge of the locking cover apparatus. The cover of the present invention is placed over the mouth or opening of the basketball rim and easily slides until attached to the rear of the rim by the molded 7 and ½ inch rim claw. After placing the cover over the basketball rim with the rim claw in place, an ordinary padlock shank is inserted through one of the ⅜ inch holes and locked around the rim to secure the device to the basketball rim. The goal cannot be used while the cover is in place over the rim and secured by the padlock. Those skilled in the art will appreciate that the conception, upon which this disclosure is based, may readily be utilized as a basis for the designing of the other structures, methods and systems for carrying out the several purposes of the present invention. It is important, therefore, that the claims be regarded as including such equivalent constructions insofar as they do not depart from the spirit and scope of the present invention.

We claim:

1. A basketball rim security device for placement over a basketball rim comprising a circular hoop through which a basketball is intended to be thrown and a horizontal generally rectangular leg for spacing the hoop away from a backboard, for preventing passage of objects through the rim and preventing hanging from the rim, said security device comprising:

a) a solid circular plate having a diameter at least as great as the maximum diameter of the hoop over which it is intended to be placed, b) a generally rectangular plate leg extending radially outwardly from said circular plate for placement over the leg of the rim, c) a U-shaped strap secured to the underside of the plate leg with the bight of the U-shape positioned generally beneath the junction of the circular plate and the plate leg and the U-shape opening away from the circular plate, d) at least one lock shackle receiving hole located along the periphery of the circular plate in an arc generally opposed to the plate leg, and e) a low friction coating covering the upper surface of the circular plate and plate leg, whereby the device may be placed over a basketball rim, coated side up, with the circular plate overlying the hoop and plate leg overlying the rim leg with the strap underlying the rim leg and the shackle of a lock may be placed through the receiving hole and about the hoop to secure the device to the rim thereby blocking passage of objects through the hoop and preventing grasping or hanging from the rim.

2. A security device for placement over a supported goal for preventing passage of objects through the goal and for preventing hanging from the goal which includes support and non-support portions, said security device comprising:

a) a cover member having first and second portions and first and second sides, the first portion dimensioned to cover substantially the entire non-support portion of the coal and the second portion extending from the first portion and dimensioned to cover the support portion of the goal;

b) at least one locking member receiving hole located through said first portion at a location where it will be located within the perimeter of the coal when the cover member covers the coal; and c) a claw attached to one side of the cover member adjacent said second portion and oriented to receive a portion of the goal between the second portion and claw;

whereby the cover member may be positioned to overly the goal with a portion of the goal received between the second portion and claw, and placement of a locking mechanism in the lock member receiving hole in engagement with the cover member and goal after the device has been located on the goal will prevent removal of the cover member.

3. The security device of claim 2, wherein a low friction coating covers the side of the cover member opposite the side of the claw.

4. The security device of claim 2, wherein the side opposite the claw is smooth.

5. The security device of claim 2, wherein the cover member has a flat surface on the side opposite the claw.

6. The security device of claim 2, wherein said claw is metal or plastic construction.

7. The security device of claim 2, wherein the cover member has a circular first section.

8. The security device of claim 2, wherein the cover member is solid.

9. The security device of claim 2, wherein said cover member is placed over a basketball rim.

10. The security device of claim 9, wherein the first portion is circular and is approximately 19 inches in diameter, and the claw is a molded U-shape of approximately 7.5 inches of length affixed to the second portion for receiving a portion of the goal between the legs of the U-shape.

* * * * *